US009650592B2

(12) United States Patent
Sanders et al.

(10) Patent No.: US 9,650,592 B2
(45) Date of Patent: May 16, 2017

(54) USE OF AMINO CARBOXYLATE FOR ENHANCING METAL PROTECTION IN ALKALINE DETERGENTS

(71) Applicant: Ecolab USA Inc., St. Paul, MN (US)

(72) Inventors: Lisa Maureen Sanders, Eagan, MN (US); Andrew M. Jensen, St. Paul, MN (US); Kristopher Hodgson, Burnsville, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 14/940,928

(22) Filed: Nov. 13, 2015

(65) Prior Publication Data

US 2016/0068786 A1 Mar. 10, 2016

Related U.S. Application Data

(63) Continuation of application No. 14/065,504, filed on Oct. 29, 2013, now Pat. No. 9,267,096.

(51) Int. Cl.

| | |
|---|---|
| ***C11D 3/10*** | (2006.01) |
| ***C11D 1/825*** | (2006.01) |
| ***C11D 1/722*** | (2006.01) |
| ***C11D 3/33*** | (2006.01) |
| ***C11D 3/04*** | (2006.01) |
| ***C11D 3/00*** | (2006.01) |
| ***C11D 3/08*** | (2006.01) |
| ***C11D 3/20*** | (2006.01) |
| ***C11D 17/00*** | (2006.01) |
| ***C11D 1/66*** | (2006.01) |

(52) U.S. Cl.

CPC ..... *C11D 3/33* (2013.01); *C11D 1/66* (2013.01); *C11D 3/0073* (2013.01); *C11D 3/044* (2013.01); *C11D 3/08* (2013.01); *C11D 3/10* (2013.01); *C11D 3/2086* (2013.01); *C11D 17/0047* (2013.01); *C11D 17/0052* (2013.01); *C11D 17/0073* (2013.01)

(58) Field of Classification Search

CPC ..... C11D 3/10; C11D 1/825; C11D 1/722; C11D 3/0073; C11D 3/044; C11D 3/08; C11D 3/2086; C11D 3/33; C11D 17/0047; C11D 17/0052; C11D 17/0073; C11D 3/361

See application file for complete search history.

(56) References Cited

U.S. PATENT DOCUMENTS

| | | | |
|---|---|---|---|
| 3,590,001 | A | 6/1971 | Taylor et al. |
| 3,741,911 | A | 6/1973 | Shane et al. |
| 3,948,818 | A | 4/1976 | Tomiyama et al. |
| 4,013,577 | A | 3/1977 | Wixon |
| 4,299,739 | A | 11/1981 | Esposito et al. |
| 4,430,126 | A | 2/1984 | Ackermann et al. |
| 4,595,520 | A | 6/1986 | Heile et al. |
| 4,820,440 | A | 4/1989 | Hemm et al. |
| 5,158,710 | A | 10/1992 | VanEenam |
| 5,292,446 | A | 3/1994 | Painter et al. |
| 5,340,501 | A | 8/1994 | Steindorf |
| 5,368,008 | A | 11/1994 | Oslin |
| 5,552,556 | A | 9/1996 | Miracle et al. |
| 5,559,089 | A | 9/1996 | Hartman et al. |
| 5,599,781 | A | 2/1997 | Haeggberg et al. |
| 5,635,103 | A | 6/1997 | Willey |
| 5,640,946 | A | 6/1997 | Oslin |
| 5,719,111 | A | 2/1998 | van den Brom et al. |
| 5,756,444 | A | 5/1998 | Walters et al. |
| 5,798,326 | A | 8/1998 | Goldstein et al. |
| 6,057,281 | A | 5/2000 | Stamm |
| 6,410,890 | B1 | 6/2002 | Kohlstrung |
| 6,440,918 | B1 | 8/2002 | France |
| 6,528,471 | B1 | 3/2003 | Del Duca et al. |
| 6,660,707 | B2 | 12/2003 | Lentsch et al. |
| 6,772,751 | B2 | 8/2004 | Deuringer et al. |
| 6,812,195 | B2 | 11/2004 | Wierenga et al. |
| 6,835,702 | B2 | 12/2004 | Herdt et al. |
| 6,835,706 | B2 | 12/2004 | Lentsch et al. |
| 7,421,987 | B2 | 9/2008 | Lou |
| 7,642,224 | B2 | 1/2010 | McRae et al. |
| 7,759,300 | B2 | 7/2010 | Besse et al. |
| 7,763,576 | B2 | 7/2010 | Tjelta et al. |
| 7,888,303 | B2 | 2/2011 | Tjelta et al. |

(Continued)

FOREIGN PATENT DOCUMENTS

| | | | |
|---|---|---|---|
| DE | 3215812 | C2 | 11/1983 |
| DE | 19730610 | C1 | 10/1998 |

(Continued)

OTHER PUBLICATIONS

Ecolab, "Apex Metal Protection, Metal-Safe Dish Machine Detergent" Labels, 1 page, as early as May 31, 2013.

Ecolab, "Apex Metal Protection Metal-Safe Dish Machine" Labels, 1 page, after Nov. 1, 2013.

BASF Safety Data Sheet—Trilon* M Liquid (30043459/MDS_GEN_US-EN), Version 1.0 (7 pages) Mar. 27, 2006.

Lanxess Energizing Chemistry Safety Data Sheet, 000969/09, Revised Apr. 26, 2004 (4 pages) Oct. 6, 2004.

Industrial Chemicals Division—PQ Corporation, "Bulletin 17-2A Typical Property Data for PQ Liquid Sodium Silicates", (1 page) Dec. 31, 2007.

Rohm and Haas—ACUMER 1000 Scale inhibitor (2 pages) Jan. 31, 2002.

(Continued)

*Primary Examiner* — Charles Boyer

(74) *Attorney, Agent, or Firm* — McKee, Voorhees & Sease, PLC

(57) ABSTRACT

The invention includes ware detergent compositions which prevent buildup of precipitates and also surprisingly provides significant metal protection of items exposed to alkaline detergent composition. According to the invention alkaline ware detergents may include an effective amount of amino carboxylate. Surprisingly, detergents which included amino carboxylate also provided significant metal protection against corrosion, even when traditional corrosion inhibiting components are reduced.

8 Claims, No Drawings

(56) References Cited

U.S. PATENT DOCUMENTS

| | | | | |
|---|---|---|---|---|
| 7,902,137 | B2 | 3/2011 | Kneipp et al. | |
| 7,922,828 | B2 | 4/2011 | Smith et al. | |
| 8,093,200 | B2 | 1/2012 | Bartelme et al. | |
| 8,101,027 | B2 | 1/2012 | Vandermeulen et al. | |
| 8,123,867 | B2 | 2/2012 | Tropsch | |
| 8,138,138 | B2 | 3/2012 | Tjelta et al. | |
| 8,198,228 | B2 | 6/2012 | Tjelta et al. | |
| 8,338,352 | B2 | 12/2012 | Tjelta et al. | |
| 8,361,952 | B2 | 1/2013 | Silvernail et al. | |
| 8,389,464 | B2 | 3/2013 | Tjelta et al. | |
| 8,530,403 | B2 | 9/2013 | Tjelta et al. | |
| 2002/0064854 | A1 | 5/2002 | Takaiwa et al. | |
| 2005/0233920 | A1 | 10/2005 | Stolte et al. | |
| 2007/0225197 | A1 | 9/2007 | Kruse et al. | |
| 2008/0015133 | A1 | 1/2008 | Rigley et al. | |
| 2008/0096784 | A1 | 4/2008 | Barg et al. | |
| 2008/0188391 | A1 | 8/2008 | Seebeck et al. | |
| 2008/0214425 | A1 | 9/2008 | Lant et al. | |
| 2008/0274930 | A1 | 11/2008 | Smith et al. | |
| 2009/0264329 | A1 | 10/2009 | Underwood et al. | |
| 2010/0000579 | A1 | 1/2010 | Reinbold et al. | |
| 2010/0160202 | A1 | 6/2010 | Housmekerides et al. | |
| 2010/0311634 | A1 | 12/2010 | Besse et al. | |
| 2010/0317559 | A1 | 12/2010 | Ryther et al. | |
| 2011/0009303 | A1* | 1/2011 | Tsumori | C08J 3/14 510/223 |
| 2011/0021403 | A1 | 1/2011 | Miralles et al. | |
| 2011/0053819 | A1 | 3/2011 | Preuschen et al. | |
| 2011/0071065 | A1 | 3/2011 | Silvernail et al. | |
| 2011/0094044 | A1* | 4/2011 | Shamayeli | C11D 1/8255 8/137 |
| 2011/0118166 | A1 | 5/2011 | Tjelta et al. | |
| 2011/0124545 | A1* | 5/2011 | Mort, III | C11D 3/40 510/220 |
| 2011/0257431 | A1 | 10/2011 | Baumann et al. | |
| 2011/0287997 | A1* | 11/2011 | Busch | C11D 3/3932 510/302 |
| 2011/0301072 | A1 | 12/2011 | Smith et al. | |
| 2012/0010117 | A1 | 1/2012 | Seebeck et al. | |
| 2012/0053104 | A1 | 3/2012 | Olson et al. | |
| 2012/0067373 | A1 | 3/2012 | Souter et al. | |
| 2012/0108484 | A1 | 5/2012 | Becker et al. | |
| 2012/0149628 | A1 | 6/2012 | Tjelta et al. | |
| 2012/0165237 | A1 | 6/2012 | Silvernail | |
| 2012/0184478 | A1* | 7/2012 | Maitro-Vogel | C11D 1/002 510/221 |
| 2013/0045909 | A1 | 2/2013 | Silvernail et al. | |
| 2013/0068254 | A1 | 3/2013 | Besse et al. | |
| 2013/0252871 | A1 | 9/2013 | Olson et al. | |
| 2014/0018278 | A1 | 1/2014 | Song et al. | |
| 2014/0018279 | A1 | 1/2014 | Song et al. | |
| 2014/0031273 | A1 | 1/2014 | Walters et al. | |
| 2014/0134709 | A1 | 5/2014 | Andersen et al. | |
| 2014/0364353 | A1 | 12/2014 | Patterson et al. | |
| 2015/0057211 | A1* | 2/2015 | Hulskotter | C11D 3/3723 510/320 |
| 2016/0060611 | A1* | 3/2016 | Alekseyev | C12Y 304/24027 510/226 |
| 2016/0075977 | A1* | 3/2016 | Miracle | C09B 29/0003 8/137 |

FOREIGN PATENT DOCUMENTS

| | | | |
|---|---|---|---|
| DE | 19838864 | A1 | 3/2000 |
| DE | 19950649 | A1 | 5/2001 |
| DE | 19961835 | A1 | 7/2001 |
| DE | 10017966 | A1 | 10/2001 |
| DE | 20220493 | U1 | 11/2003 |
| EP | 0812808 | A1 | 12/1997 |
| EP | 1478886 | B1 | 4/2007 |
| EP | 2166092 | A1 | 3/2010 |
| EP | 2361964 | A1 | 8/2011 |
| GB | 1221186 | | 2/1971 |
| GB | 1232120 | | 5/1971 |
| JP | 2000186297 | A | 7/2000 |
| WO | 9403554 | A1 | 2/1994 |
| WO | 0058430 | | 10/2000 |
| WO | 02068876 | A1 | 9/2002 |
| WO | 03073002 | A1 | 9/2003 |
| WO | 2008095562 | A1 | 8/2008 |
| WO | 2009092699 | A1 | 7/2009 |
| WO | 2010045686 | A1 | 4/2010 |
| WO | 2011003842 | A1 | 1/2011 |
| WO | 2011025624 | A1 | 3/2011 |
| WO | 2011080540 | A1 | 7/2011 |
| WO | 2011100344 | A1 | 8/2011 |
| WO | 2011116775 | A2 | 9/2011 |
| WO | 2011144699 | A1 | 11/2011 |
| WO | 2012025740 | A1 | 3/2012 |
| WO | 2012028203 | A1 | 3/2012 |
| WO | 2012038755 | A1 | 3/2012 |
| WO | 2012045365 | A1 | 4/2012 |

OTHER PUBLICATIONS

Ecolab USA Inc., PCT/US2013/064748 filed Oct. 13, 2013, "The International Search Report and the Written Opinion of the International Searching Authority, or the Declaration", mail date Jan. 28, 2014.

Rohm and Haas—Material Safety Data Sheet—ACUMER (TM) 1000 Polymer, (6 pages) Sep. 24, 2007.

PQ Corporation—Material Safety Data Sheet—RU Sodium Silicate Solution, (5 pages), Jun. 13, 2006.

Ecolab USA Inc., PCT/US2013/078513 filed Dec. 31, 2013, "The International Search Report and the Written Opinion of the International Searching Authority, or the Declaration", mail date Apr. 23, 2014.

Galiano et al., "Stabilization/solidification of a municipal solid waste incineration residue using fly ash-based jeopolymers", Journal of Hazardous Materials, 9 pages, issued on Sep. 18, 2010.

Provis et al., "Correlating mechanical and thermal properties of sodium silicate-fly ash geopolymers", Colloids and Surfaces A: Pysicochemical and Engineering Aspects, 7 pages, issued on Nov. 21, 2008.

Sasai et al., "Preparation and characterization of activated carbon/zeolite composites from industrial solid wastes", www.witpress.com, retrieved from the Internet on Dec. 2, 2015.

Subramanian et al., "Studies on Chemical Speciation of Sodium Aerosols Produced in Sodium Fire", Nuclear Technology vol. 165, 13 pages, issued on Jul. 1, 2008.

* cited by examiner

USE OF AMINO CARBOXYLATE FOR ENHANCING METAL PROTECTION IN ALKALINE DETERGENTS

CROSS-REFERENCE TO RELATED APPLICATIONS

This is a Continuation Application of U.S. Ser. No. 14/065,504 filed Oct. 29, 2013, which is herein incorporated by reference in their entirety.

FIELD OF THE INVENTION

The invention relates to detergent compositions effective for reducing corrosion and providing metal protection in alkaline ware wash detergent formulations through the use of amino carboxylates. Methods employing the detergent compositions and preventing corrosion are provided for use in alkaline conditions between about 9 and 12.5.

BACKGROUND OF THE INVENTION

Alkaline detergents general include alkali metal carbonate and/or hydroxide as the source of alkalinity and are often referred to as ash detergents and caustic detergents, respectively. Detergent formulations employing alkali metal carbonates and/or alkali metal hydroxides are known to provide effective detergency. Formulations can vary greatly in their degree of corrosiveness, acceptance as consumer-friendly and/or environmentally-friendly products, as well as other detergent characteristics. Generally, as the alkalinity of these detergent compositions increase, the difficulty in protecting metal surfaces also increases. A need therefore exists for detergent compositions that minimize and/or eliminate metal corrosion of items within systems employing these detergents.

Various corrosion inhibitors are known and have been used to prevent corrosion of surfaces that come into contact with aqueous alkaline solutions. Some known corrosive inhibitors include the silicates, such as sodium silicate. Unfortunately, the sodium silicates begin to precipitate from aqueous solution at PHS below 11, thus, greatly reducing the effectiveness of these materials to prevent corrosion of the contacted surfaces when used in aqueous cleaning solutions having a lower pH. Additionally, when the silicate-containing compositions or their residues are allowed to dry on the surface to be cleaned, films or spots are often formed, which are visible and which are themselves very difficult to remove. The presence of these silicon-containing deposits can affect the texture of the cleaned surface, the appearance of the surface, and on cooking or storage surfaces, can affect the taste of the materials that come into contact with the cleaned surfaces.

It is also known to include calcium ions within cleaning composition to inhibit the attack of hydroxide ion on alkali sensitive metals. However, it has proven to be difficult to introduce calcium ions into alkaline cleaners without inducing precipitation of hydroxides of the calcium. This is especially true for highly alkaline solutions, such as concentrated solutions that are intended for dilution into use solutions. Theoretically, the protection against corrosion in such systems is based on the presence of the calcium ion in solution, so precipitation of the calcium ions adversely affects the corrosion inhibiting effectiveness of the system.

Additionally, the formulations could not include strong chelating agents that could bind with the calcium ion, and again reduce the effectiveness of the calcium ion as a corrosion inhibitor.

Accordingly, it is an objective of the claimed invention to develop alkaline detergent compositions with improved metal protection, reduced precipitation of particulates, and maintained effective detergency.

A further object of the invention is to provide methods for employing alkaline detergents between pHs from about 9 to about 12.5 without causing significant corrosion of metal surfaces.

BRIEF SUMMARY OF THE INVENTION

An advantage of the invention is the prevention/reduction of corrosion on warewashed surfaces through the application of the detergent compositions of the invention which include amino carboxylate. As a result, the aesthetic appearances of the treated substrate surfaces are improved, and particulate matter in the residual wash water is also reduced.

In an embodiment, the present invention provides a detergent composition comprising: an amino carboxylate; and an alkalinity source comprising an alkali metal hydroxide, carbonate, metasilicate and/or silicate wherein a use solution of the detergent composition has a pH between about 9 and 12.5.

In a further embodiment, the present invention provides a method of cleaning while preventing/reducing metal corrosion on a cleaned surface comprising: applying a detergent composition to a substrate surface, wherein the detergent composition comprises an amino carboxylate and an alkalinity source comprising an alkali metal hydroxide, carbonate, carbonate, metasilicate, silicate and/or combinations of the same, wherein the detergent composition is effective for protecting metal surfaces from corrosion. This is surprising as this result was observed even when the metal protection component was reduced. The detergent composition also help to eliminate suspended particles that can precipitate in hard water situations and that can clog warewash units and dispensers.

The cleaning composition includes an amino carboxylate and any of a variety of other components useful for alkaline cleaning compositions. For example, the composition can include an amino carboxylate, a source of alkalinity, water, surfactant, and/or the like. In an embodiment, the composition can include about 1 wt. % to about 3.5 wt. % amino carboxylate; about 1 wt. % to about 90 wt. % source of alkalinity; about 0 to about 10 wt. % surfactant; with the remainder being other components such as a chelant, silicate metal protectors, fillers, stabilizers, corrosion inhibitors, buffers, fragrance etc. The composition of the invention employing amino carboxylate also provides improved metal protection while other traditional metal protectors such as sodium silicate is reduced.

Articles which require such cleaning according to the invention includes any article with a surface that contains an alkaline sensitive metal, such as, aluminum or aluminum containing alloys. Such articles can be found in industrial plants, maintenance and repair services, manufacturing facilities, kitchens, and restaurants. Exemplary equipment having a surface containing an alkaline sensitive metals include sinks, cookware, utensils, machine parts, vehicles, tanker trucks, vehicle wheels, work surfaces, tanks, immersion vessels, spray washers, and ultrasonic baths. In addition, a detergent composition is provided according to the invention that can be used in environments other than inside a dishwashing machine. Alkaline sensitive metals in need of cleaning are found in several locations. Exemplary locations also include trucks, vehicle wheels, ware, and facilities. One exemplary application of the alkaline sensitive metal cleaning detergent composition for cleaning alkaline sensitive metals can be found in cleaning vehicle wheels in a vehicle washing facility. Compositions including the novel corrosion inhibitor of the invention may be used in any of these applications and the like.

The invention also includes methods for cleaning aluminum and/or aluminum containing alloys by contacting the surface of the same with the detergent/cleaning compositions of the invention and rising thereafter.

The invention also includes methods for protecting aluminum and/or aluminum containing alloys from corrosion by use of the novel corrosion inhibiting composition of the invention. The method involves the step of contacting the surface of aluminum, or an aluminum containing alloy with the corrosion inhibiting composition of the invention. The novel corrosion inhibiting composition includes one or more aminocarboxylates.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION OF THE PREFERRED EMBODIMENT

The present invention relates to detergent compositions employing an amino carboxylate. The detergent compositions have many advantages over conventional alkaline detergents. For example, the detergent compositions provide effective improved metal protection, and reduction of hard water precipitate that can clog dispensers all while maintaining cleaning performance at alkaline conditions from about 9 to about 12.5.

The embodiments of this invention are not limited to particular alkaline detergent compositions, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The phrase "alkaline sensitive metal" identifies those metals that exhibit corrosion and/or discoloration when exposed to an alkaline detergent in solution. An alkaline solution is an aqueous solution having a pH that is greater than 8. Exemplary alkaline sensitive metals include soft metals such as aluminum, nickel, tin, zinc, copper, brass, bronze, and mixtures thereof. Aluminum and aluminum alloys are common alkaline sensitive metals that can be cleaned by the warewash detergent compositions of the invention.

As used herein, the term "about" modifying the quantity of a component or ingredient in the compositions of the invention or employed in the methods of the invention refers to variation in the numerical quantity that can occur, for example, through typical measuring and liquid handling procedures used for making concentrates or use solutions in the real world; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities.

The term "surfactant" or "surface active agent" refers to an organic chemical that when added to a liquid changes the properties of that liquid at a surface.

"Cleaning" means to perform or aid in soil removal, bleaching, de-scaling, de-staining, microbial population reduction, rinsing, or combination thereof.

As used herein, the term "substantially free" refers to compositions completely lacking the component or having such a small amount of the component that the component does not affect the performance of the composition. The component may be present as an impurity or as a contaminant and shall be less than 0.5 wt. %. In another embodiment, the amount of the component is less than 0.1 wt. % and in yet another embodiment, the amount of component is less than 0.01 wt. %.

As used herein, a "solid" cleaning composition refers to a cleaning composition in the form of a solid such as a powder, a particle, an agglomerate, a flake, a granule, a pellet, a tablet, a lozenge, a puck, a briquette, a brick, a solid block, a unit dose, or another solid form known to those of skill in the art. The term "solid" refers to the state of the detergent composition under the expected conditions of storage and use of the solid detergent composition. In general, it is expected that the detergent composition will remain in solid form when exposed to elevated temperatures of 100° F. and preferably 120° F. A cast, pressed, or extruded "solid" may take any form including a block. When referring to a cast, pressed, or extruded solid it is meant that the hardened composition will not flow perceptibly and will substantially retain its shape under moderate stress, pressure, or mere gravity. For example, the shape of a mold when removed from the mold, the shape of an article as formed upon extrusion from an extruder, and the like. The degree of hardness of the solid cast composition can range from that of a fused solid block, which is relatively dense and hard similar to concrete, to a consistency characterized as being malleable and sponge-like, similar to caulking material.

The term "actives" or "percent actives" or "percent by weight actives" or "actives concentration" are used interchangeably herein and refers to the concentration of those ingredients involved in cleaning expressed as a percentage minus inert ingredients such as water or salts.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

As used herein, the term "substantially free" refers to compositions completely lacking the component or having such a small amount of the component that the component does not affect the effectiveness of the composition. The component may be present as an impurity or as a contaminant and shall be less than 0.5 wt. %. In another embodiment, the amount of the component is less than 0.1 wt.-% and in yet another embodiment, the amount of component is less than 0.01 wt. %.

The terms "feed water," "dilution water," and "water" as used herein, refer to any source of water that can be used with the methods and compositions of the present invention. Water sources suitable for use in the present invention include a wide variety of both quality and pH, and include but are not limited to, city water, well water, water supplied by a municipal water system, water supplied by a private water system, and/or water directly from the system or well. Water can also include water from a used water reservoir, such as a recycle reservoir used for storage of recycled water, a storage tank, or any combination thereof. Water also includes food process or transport waters. It is to be understood that regardless of the source of incoming water for systems and methods of the invention, the water sources may be further treated within a manufacturing plant. For example, lime may be added for mineral precipitation, carbon filtration may remove odoriferous contaminants, additional chlorine or chlorine dioxide may be used for disinfection or water may be purified through reverse osmosis taking on properties similar to distilled water.

As used herein, the term "ware" refers to items such as eating and cooking utensils, dishes, and other hard surfaces such as showers, sinks, toilets, bathtubs, countertops, windows, mirrors, transportation vehicles, and floors. As used herein, the term "warewashing" refers to washing, cleaning, or rinsing ware. Ware also refers to items made of plastic. Types of plastics that can be cleaned with the compositions according to the invention include but are not limited to, those that include polycarbonate polymers (PC), acrilonitrile-butadiene-styrene polymers (ABS), and polysulfone polymers (PS). Another exemplary plastic that can be cleaned using the compounds and compositions of the invention include polyethylene terephthalate (PET).

The term "weight percent," "wt. %," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt. %," etc.

The term "clogged" and variations thereof, in relation to a dispenser or other drainage system as used hereinafter, refers to a dispenser in which a solid or an aggregate of solids has formed in the effluent feed line, preventing the detergent from being introduced into the dish machine. Typically the concentrated detergent solution builds up in the detergent dispenser until it overflows, meanwhile the machine continues to operate without detergent. This can be caused by a number of things including, but not limited to, the precipitation of certain detergent ingredient chemicals in the presence of hard water.

The methods and compositions of the present invention may comprise, consist essentially of, or consist of the components and ingredients of the present invention as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

Compositions of the Invention

Amino Carboxylate

According to the invention, amino carboxylates are used to help reduce buildup of precipitates from the alkaline detergents, which in combination with hard water, can clog ware wash machines. Exemplary of this problem would be magnesium or calcium carbonate accumulation. Applicants have surprisingly also found that the use of amino carboxylate to reduce this problem, also results in an increase in metal protection. This was so even when the traditional metal protection components were reduced. Thus the invention employs the use of one or more amino carboxylates for metal protection and precipitate reduction in alkaline detergents.

Examples of suitable amino carboxylates useful in the present invention include biodegradable amino carboxylates. These include: ethanoldiglycine, e.g., an alkali metal salt of ethanoldiglycine, such as disodium ethanoldiglycine ($Na_2EDG$); methylgylcinediacetic acid, e.g., an alkali metal salt of methylgylcinediacetic acid, such as trisodium methylgylcinediacetic acid; iminodisuccinic acid, e.g., an alkali metal salt of iminodisuccinic acid, such as iminodisuccinic acid sodium salt; N,N-bis (carboxylatomethyl)-L-glutamic acid (GLDA), e.g., an alkali metal salt of N,N-bis(carboxylatomethyl)-L-glutamic acid, such as iminodisuccinic acid sodium salt (GLDA-Na.sub.4); [S—S]-ethylenediaminedisuccinic acid (EDDS), e.g., an alkali metal salt of [S—S]-ethylenediaminedisuccinic acid, such as a sodium salt of [S—S]-ethylenediaminedisuccinic acid; 3-hydroxy-2,2'-iminodisuccinic acid (HIDS), e.g., an alkali metal salt of 3-hydroxy-2,2'-iminodisuccinic acid, such as tetrasodium 3-hydroxy-2,2'-iminodisuccinate. Examples of suitable commercially available biodegradable aminocarboxylates include, but are not limited to: Versene HEIDA (52%), available from Dow Chemical, Midland, Mich.; Trilon M (40% MGDA), available from BASF Corporation, Charlotte, N.C.; IDS, available from Lanxess, Leverkusen, Germany; Dissolvine GL-38 (38%), available from Akzo Nobel, Tarrytown, N.J.; Octaquest (37%), available from; and HIDS (50%), available from Innospec Performance Chemicals (Octel Performance Chemicals), Edison, N.J.

The cleaning composition can contain a sufficient amount of the amino-carboxylate to assist with metal protection as well as reducing particulate matter in the water to prevent clogging. For example, the amino-carboxylate surprisingly, can reduce corrosion of metals exposed to alkaline detergents as well as reducing total dissolved solids. Suitable concentrations of the amino-carboxylate and salts thereof in the cleaning solution include between about 0.01% and about 7% by weight of the cleaning solution. Particularly suitable concentrations of the amino-carboxylate and salts thereof in the cleaning solution include between about 0.04% and about 5% or between about 0.1% and about 3.5% by weight of the cleaning solution.

Alkalinity Source

The detergent compositions include an alkalinity source. Exemplary alkalinity sources include alkali metal carbonates and/or alkali metal hydroxides.

Alkali metal carbonates used in the formulation of detergents are often referred to as ash-based detergents and most often employ sodium carbonate. Additional alkali metal carbonates include, for example, sodium or potassium carbonate. In aspects of the invention, the alkali metal carbonates are further understood to include metasilicates, silicates, bicarbonates and sesquicarbonates. According to the invention, any "ash-based" or "alkali metal carbonate" shall also be understood to include all alkali metal carbonates, metasilicates, silicates, bicarbonates and/or sesquicarbonates.

Alkali metal hydroxides used in the formulation of detergents are often referred to as caustic detergents. Examples of suitable alkali metal hydroxides include sodium hydroxide, potassium hydroxide, and lithium hydroxide. Exemplary alkali metal salts include sodium carbonate, potassium carbonate, and mixtures thereof. The alkali metal hydroxides may be added to the composition in any form known in the art, including as solid beads, dissolved in an aqueous solution, or a combination thereof. Alkali metal hydroxides are commercially available as a solid in the form of prilled solids or beads having a mix of particle sizes ranging from about 12-100 U.S. mesh, or as an aqueous solution, as for example, as a 45% and a 50% by weight solution.

In addition to the first alkalinity source, the detergent composition may comprise a secondary alkalinity source. Examples of useful secondary alkaline sources include, but are not limited to: metal silicates such as sodium or potassium silicate or metasilicate; metal carbonates such as sodium or potassium carbonate, bicarbonate, sesquicarbonate; metal borates such as sodium or potassium borate; and ethanolamines and amines. Such alkalinity agents are commonly available in either aqueous or powdered form, either of which is useful in formulating the present detergent compositions.

An effective amount of one or more alkalinity sources is provided in the detergent composition. An effective amount is referred to herein as an amount that provides a use composition having a pH of at least about 9, preferably at least about 10. When the use composition has a pH of between about 9 and about 10, it can be considered mildly alkaline, and when the pH is greater than about 12, the use composition can be considered caustic. In some circumstances, the detergent composition may provide a use composition that is useful at pH levels below about 9, such as through increased dilution of the detergent composition. In general, the amount of alkalinity provided in the concentrate can be in an amount of at least about 0.05 wt. % based on the weight of the alkaline concentrate. The source of alkalinity in the concentrate is preferably between about 0.05 wt. % and about 99 wt. %, more preferably is between about 0.1 wt. % and about 95 wt. %, and most preferably is between 0.5 wt. % and 90 wt. %.

Metal Protecting Silicate

The invention can also include a metal protecting silicate. Applicants have found that this traditional component of ware washing compositions can be reduced or even eliminated entirely with the use of the amino carboxylates according to the invention.

The silicates which may be employed in some embodiments of the invention are those that have conventionally been used in warewashing formulations. For example, typical alkali metal silicates are those powdered, particulate or granular silicates which are either anhydrous or preferably which contain water of hydration (5 to 25 wt. %, preferably 15 to 20 wt. % water of hydration). These silicates can be sodium silicates and have a $Na_2O:SiO_2$ ratio of about 1:1 to about 1:5, respectively, and typically contain available bound water in the amount of from 5 to about 25 wt. %. In general, the silicates of the present invention have a $Na_2O:SiO_2$ ratio of 1:1 to about 1:3.75, preferably about 1:1.5 to about 1:3.75 and most preferably about 1:1.5 to about 1:2.5. One example is a ratio of 0.0066 wt. % to about 0.1166 wt. %. A silicate with a $Na_2O:SiO_2$ ratio of about 1:2 and about 16 to 22 wt. % water of hydration is suitable.

For example, such silicates are available in powder form as GD Silicate and in granular form as Britesil H-20, from PQ Corporation. These ratios may be obtained with single silicate compositions or combinations of silicates which upon combination result in the preferred ratio. The hydrated silicates at preferred ratios, a $Na_2O:SiO_2$ ratio of about 1:1.5 to about 1:2.5 have been found to provide the optimum metal protection and rapidly forming solid block detergent. The amount of silicate used in forming the compositions of the invention tend to vary between about 5 wt. % and about 40 wt. %, preferably about 10 wt. % to about 35 wt. % and more preferably from about 15 wt. % to about 30 wt. % depending on degree of hydration. Hydrated silicates are preferred.

Suitable silicates for use in the present compositions include sodium silicate, anhydrous sodium metasilicate, and anhydrous sodium silicate.

Surfactants

The detergent composition can include at least one cleaning agent comprising a surfactant or surfactant system. A variety of surfactants can be used in a warewashing composition, such as anionic, nonionic, cationic, and zwitterionic surfactants. It should be understood that surfactants are an optional component of the detergent composition and can be excluded. Exemplary ranges of surfactant in a concentrate include about 0.05 wt. % to 15 wt. %, more preferably about 0.5 wt. % to 10 wt. %, and most preferably about 1 wt. % to 7.5 wt. %.

Exemplary surfactants that can be used are commercially available from a number of sources. For a discussion of surfactants, see Kirk-Othmer, Encyclopedia of Chemical Technology, Third Edition, volume 8, pages 900-912. When the composition includes a cleaning agent, the cleaning agent can be provided in an amount effective to provide a desired level of cleaning.

Anionic surfactants useful detergent compositions include, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Exemplary anionic surfactants include sodium alkylarylsulfonate, alpha-olefinsulfonate, and fatty alcohol sulfates.

Nonionic surfactants useful in the detergent composition include, for example, those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC® (BASF-Wyandotte), and the like; and other like nonionic compounds. Silicone surfactants such as the ABIL® B8852 can also be used.

Cationic surfactants that can be used in the detergent composition include amines such as primary, secondary and tertiary monoamines with $C_{1-8}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$) dimethylbenzyl ammonium chloride, n-tetradecyldimethylbenzylammonium chloride monohydrate, a naphthylene-substituted quaternary ammonium chloride such as dimethyl-1-naphthylmethylammonium chloride, and the like. The cationic surfactant can be used to provide sanitizing properties.

Zwitterionic surfactants that can be used in the detergent composition include betaines, imidazolines, and propionates. If the detergent composition is intended to be used in an automatic dishwashing or warewashing machine, the surfactants selected, if any surfactant is used, can be those that provide an acceptable level of foaming. It should be understood that warewashing compositions for use in automatic dishwashing or warewashing machines are generally considered to be low-foaming compositions.

The surfactant can be selected to provide low foaming properties. One would understand that low foaming surfactants that provide the desired level of detersive activity are advantageous in an environment such as a dishwashing machine where the presence of large amounts of foaming can be problematic. In addition to selecting low foaming surfactants, one would understand that defoaming agents can be utilized to reduce the generation of foam. Accordingly, surfactants that are considered low foaming surfactants as well as other surfactants can be used in the detergent composition and the level of foaming can be controlled by the addition of a defoaming agent.

Chelant

The compositions of the invention can also include a chelant at a level of from 0.1% to 20%, preferably from 0.2% to 15%, more preferably from 0.3% to 10% by weight of total composition. Chelation herein means the binding or complexation of a bi- or multidentate ligand. These ligands, which are often organic compounds, are called chelants, chelators, chelating agents, and/or sequestering agent. Chelating agents form multiple bonds with a single metal ion. Chelants, are chemicals that form soluble, complex molecules with certain metal ions, inactivating the ions so that they cannot normally react with other elements or ions to produce precipitates or scale. The ligand forms a chelate complex with the substrate. The term is reserved for complexes in which the metal ion is bound to two or more atoms of the chelant. The chelants for use in the present invention are those having crystal growth inhibition properties, i.e. those that interact with the small calcium and magnesium carbonate particles preventing them from aggregating into hard scale deposit. The particles repel each other and remain suspended in the water or form loose aggregates which may settle. These loose aggregates are easily rinse away and do not form a deposit.

Suitable chelating agents can be selected from the group consisting of amino carboxylates (this may be the same amino carboxylate that is used for metal protection, or an additional further amino carboxylate), amino phosphonates, polyfunctionally-substituted aromatic chelating agents and mixtures thereof. Preferred chelants for use herein are weak chelants such as the amino acids based chelants and preferably citrate, citrate, tararate, and glutamic-N,N-diacetic acid and derivatives and/or Phosphonate based chelants and preferably Diethylenetriamine penta methylphosphonic acid.

Amino carboxylates include ethylenediaminetetra-acetates, N-hydroxyethylethylenediaminetriacetates, nitrilotriacetates, ethylenediamine tetrapro-prionates, triethylenetetraaminehexacetates, diethylenetriaminepentaacetates, and ethanoldi-glycines, alkali metal, ammonium, and substituted ammonium salts therein and mixtures therein. As well as MGDA (methyl-glycine-diacetic acid), and salts and derivatives thereof and GLDA (glutamic-N,N-diacetic acid) and salts and derivatives thereof. GLDA (salts and derivatives thereof) is especially preferred according to the invention, with the tetrasodium salt thereof being especially preferred.

Other suitable chelants include amino acid based compound or a succinate based compound. The term "succinate based compound" and "succinic acid based compound" are used interchangeably herein. Other suitable chelants are described in U.S. Pat. No. 6,426,229. Particular suitable chelants include; for example, aspartic acid-N-monoacetic acid (ASMA), aspartic acid-N,N-diacetic acid (ASDA), aspartic acid-N-monopropionic acid (ASMP), iminodisuccinic acid (IDS), Imino diacetic acid (IDA), N-(2-sulfomethyl)aspartic acid (SMAS), N-(2-sulfoethyl)aspartic acid (SEAS), N-(2-sulfomethyl)glutamic acid (SMGL), N-(2-sulfoethyl)glutamic acid (SEGL), N-methyliminodiacetic acid (MIDA), alanine-N,N-diacetic acid (ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts or ammonium salts thereof. Also suitable is ethylenediamine disuccinate ("EDDS"), especially the [S,S] isomer as described in U.S. Pat. No. 4,704,233. Furthermore, Hydroxyethyleneiminodiacetic acid, Hydroxyiminodisuccinic acid, Hydroxyethylene diaminetriacetic acid is also suitable. Particularly preferred is alanine, N,N-bis(carboxymethyl)-, trisodium salt.

Other chelants include homopolymers and copolymers of polycarboxylic acids and their partially or completely neutralized salts, monomeric polycarboxylic acids and hydroxycarboxylic acids and their salts. Preferred salts of the above-mentioned compounds are the ammonium and/or alkali metal salts, i.e. the lithium, sodium, and potassium salts, and particularly preferred salts are the sodium salts.

Suitable polycarboxylic acids are acyclic, alicyclic, heterocyclic and aromatic carboxylic acids, in which case they contain at least two carboxyl groups which are in each case separated from one another by, preferably, no more than two carbon atoms. Polycarboxylates which comprise two carboxyl groups include, for example, water-soluble salts of, malonic acid, (ethyl enedioxy) diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Another suitable polycarboxylic acid is the homopolymer of acrylic acid. Preferred are the polycarboxylates end capped with sulfonates.

Amino phosphonates are also suitable for use as chelating agents and include ethylenediaminetetrakis(methylenephosphonates) as DEQUEST. Preferred, these amino phosphonates that do not contain alkyl or alkenyl groups with more than about 6 carbon atoms.

Polyfunctionally-substituted aromatic chelating agents are also useful in the compositions herein such as described in U.S. Pat. No. 3,812,044. Preferred compounds of this type in acid form are dihydroxydisulfobenzenes such as 1,2-dihydroxy-3,5-disulfobenzene.

Further suitable polycarboxylates chelants for use herein include citric acid, lactic acid, acetic acid, succinic acid, formic acid all preferably in the form of a water-soluble salt. Other suitable polycarboxylates are oxodisuccinates, carboxymethyloxysuccinate and mixtures of tartrate monosuccinic and tartrate disuccinic acid such as described in U.S. Pat. No. 4,663,071.

Corrosion Inhibitor

The detergent composition may also include a corrosion inhibitor. In general, it is expected that the corrosion inhibitor component will loosely hold calcium to reduce precipitation of any calcium carbonate (when this is used as an alkalinity source) once it is subjected to a pH of at least 8.0.

Exemplary corrosion inhibitors include phosphonocarboxylic acids, phosphonates, phosphates, polymers, and mixtures thereof. Exemplary phosphonocarboxylic acids include those available under the name Bayhibit™ AM from Bayer, and include 2-phosphonobutane-1,2,4, tricarboxylic acid (PBTC). Exemplary phosphonates include amino tri (methylene phosphonic acid), 1-hydroxy ethylidene 1-1-diphosphonic acid, ethylene diamine tetra(methylene phosphonic acid), hexamethylene diamine tetra(methylene phosphonic acid), diethylene triamine penta(methylene phosphonic acid), and mixtures thereof. Exemplary phosphonates are available under the name Dequest™ from Monsanto. Exemplary polymers include polyacrylates, polymethacrylates, polyacrylic acid, polyitaconic acid, polymaleic acid, sulfonated polymers, copolymers and mixtures thereof. It should be understood that the mixtures can include mixtures of different acid substituted polymers within the same general class. In addition, it should be understood that salts of acid substituted polymers can be used. The useful carboxylated polymers may be generically categorized as water-soluble carboxylic acid polymers such as polyacrylic and polymethacrylic acids or vinyl addition polymers. Of the vinyl addition polymers contemplated, maleic anhydride copolymers as with vinyl acetate, styrene, ethylene, isobutylene, acrylic acid and vinyl ethers are examples. The polymers tend to be water-soluble or at least colloidally dispersible in water. The molecular weight of these polymers may vary over a broad range although it is preferred to use polymers having average molecular weights ranging between 1,000 up to 1,000,000, more preferably a molecular weight of 100,000 or less, and most preferably a molecular weight between 1,000 and 10,000.

The polymers or copolymers (either the acid-substituted polymers or other added polymers) may be prepared by either addition or hydrolytic techniques. Thus, maleic anhydride copolymers are prepared by the addition polymerization of maleic anhydride and another comonomer such as styrene. The low molecular weight acrylic acid polymers may be prepared by addition polymerization of acrylic acid or its salts either with itself or other vinyl comonomers. Alternatively, such polymers may be prepared by the alkaline hydrolysis of low molecular weight acrylonitrile homopolymers or copolymers. For such a preparative technique see Newman U.S. Pat. No. 3,419,502.

The threshold agent/crystal modifier component should be provided in an amount sufficient so that when it is in the use solution, it sufficiently disrupts crystal growth or prevents the precipitation of calcium carbonate and other insoluble salts such as magnesium silicate, magnesium hydroxide, and the like. In a preferred embodiment, the threshold agent/crystal modifier component can be provided in a range of about 0.01 wt. % to about 25 wt. %, and more preferably in a range between about 0.05 wt. % and about 20 wt. %, and most preferably between about 0.1% and 15% based on the weight of the concentrate. It should be understood that the polymers, phosphonocarboxylates, and phosphonates can be used alone or in combination.

Fillers

The rinse aid can optionally include a minor but effective amount of one or more of a filler which does not necessarily perform as a rinse and/or cleaning agent per se, but may cooperate with a rinse agent to enhance the overall capacity of the composition. Some examples of suitable fillers may include sodium chloride, starch, sugars, $C_1$-$C_{10}$ alkylene glycols such as propylene glycol, and the like. In some embodiments, a filler can be included in an amount in the range of up to about 20 wt. %, and in some embodiments, in the range of about 1-15 wt. %. Sodium sulfate is conventionally used as inert filler.

pH-Adjusting Compound

The composition of the present invention can include the pH-adjusting compounds to achieve the desired alkalinity of the detergent. The pH-adjusting compound, if present is present in an amount sufficient to achieve the desired pH, typically of about 0.5% to about 3.5%, by weight.

Examples of basic pH-adjusting compounds include, but are not limited to, ammonia; mono-, di-, and trialkyl amines; mono-, di-, and trialkanolamines; alkali metal and alkaline earth metal hydroxides; alkali metal phosphates; alkali sulfates; alkali metal carbonates; and mixtures thereof. However, the identity of the basic pH adjuster is not limited, and any basic pH-adjusting compound known in the art can be used. Specific, nonlimiting examples of basic pH-adjusting compounds are ammonia; sodium, potassium, and lithium hydroxides; sodium and potassium phosphates, including hydrogen and dihydrogen phosphates; sodium and potassium carbonate and bicarbonate; sodium and potassium sulfate and bisulfate; monoethanolamine; trimethylamine; isopropanolamine; diethanolamine; and triethanolamine.

Water

The detergent composition includes water. Water many be independently added to the composition or may be provided in the composition as a result of its presence in an aqueous material that is added to the composition. For example, materials added to the composition include water or may be prepared in an aqueous premix available for reaction with the solidification agent component(s). Typically, water is introduced into the composition to provide the detergent composition with a desired viscosity prior to solidification, and to provide a desired rate of solidification.

In general, it is expected that water may be present as a processing aid and may be removed or become water of hydration. It is expected that water may be present in the composition. In the solid composition, it is expected that the water will be present in the range of between 2 wt. % and 15 wt. %. For example, water is present in embodiments of the composition in the range of between 2 wt. % to about 12 wt. %, or further embodiments in the range of between 3 wt. % and about 10 wt. %, or yet further embodiments in the range of between 3 wt. % and 4 wt. %. It should be additionally appreciated that the water may be provided as deionized water or as softened water.

Hardening/Solidification Agents/Solubility Modifiers

Traditionally, sodium sulfate and urea are used for solidification if the composition is to be in solid form. Examples of other hardening agents include an amide such stearic monoethanolamide or lauric diethanolamide, or an alkylamide, and the like; a solid polyethylene glycol, or a solid EO/PO block copolymer, and the like; starches that have been made water-soluble through an acid or alkaline treatment process; various inorganics that impart solidifying properties to a heated composition upon cooling, and the like. Such compounds may also vary the solubility of the composition in an aqueous medium during use such that the rinse aid and/or other active ingredients may be dispensed from the solid composition over an extended period of time. The composition may include a hardening agent in an amount in the range of up to about 30 wt. %. In some embodiments, hardening agents are may be present in an amount in the range of 5-25 wt. %, often in the range of 10 to 25 wt. % and sometimes in the range of about 5 to about 15 wt.-%.

Other Additives

The detergent composition can include other additives such as bleaching agents, detergent builders, hardening agents or solubility modifiers, defoamers, anti-redeposition agents, threshold agents, stabilizers, dispersants, enzymes, aesthetic enhancing agents (i.e., dye, perfume), and the like. Adjuvants and other additive ingredients will vary according to the type of composition being manufactured. It should be understood that these additives are optional and need not be included in the cleaning composition. When they are included, they can be included in an amount that provides for the effectiveness of the particular type of component.

Bleaching Agents

Bleaching agents for use in a cleaning compositions for lightening or whitening a substrate, include bleaching compounds capable of liberating an active halogen species, such as $Cl_2$, $Br_2$, —OCL and/or —$OBr^-$, under conditions typically encountered during the cleansing process. Suitable bleaching agents for use in the present cleaning compositions include, for example, chlorine-containing compounds such as chlorine, hypochlorite, and/or chloramine. Exemplary halogen-releasing compounds include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. The composition can include an effective amount of a bleaching agent. In a preferred embodiment when the concentrate includes a bleaching agent, it can be included in an amount of about 0.1 wt. % to about 60 wt. %, more preferably between about 1 wt. % and about 20 wt. %, and most preferably between about 3 wt. % and about 8 wt. %.

Defoaming Agent

A defoaming agent for reducing the stability of foam may also be included in the composition to reduce foaming. When the concentrate includes a defoaming agent, the defoaming agent can be provided in an amount of between about 0.01 wt. % and about 3 wt. %.

Examples of defoaming agents that can be used in the composition includes ethylene oxide/propylene block copolymers silicone compounds such as silica dispersed in polydimethylsiloxane, polydimethylsiloxane, and functionalized polydimethylsiloxane such as those available under the name Abil B9952, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-Redeposition Agent

The composition can include an anti-redeposition agent for facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. In a preferred embodiment, the anti-redeposition agent, when included in the concentrate, is added in an amount between about 0.5 wt. % and about 10 wt. %, and more preferably between about 1 wt. % and about 5 wt. %.

Stabilizing agents that can be used include primary aliphatic amines, betaines, borate, calcium ions, sodium citrate, citric acid, sodium formate, glycerine, maleonic acid, organic diacids, polyols, propylene glycol, and mixtures thereof. The concentrate need not include a stabilizing agent, but when the concentrate includes a stabilizing agent, it can be included in an amount that provides the desired level of stability of the concentrate. In a preferred embodiment the amount of stabilizing agent is about 0 to about 20 wt. %, more preferably about 0.5 wt. % to about 15 wt. %, and most preferably about 2 wt. % to about 10 wt. %.

Dispersants

Dispersants that can be used in the composition include maleic acid/olefin copolymers, polyacrylic acid, and mixtures thereof. The concentrate need not include a dispersant, but when a dispersant is included it can be included in an amount that provides the desired dispersant properties. Exemplary ranges of the dispersant in the concentrate can be between about 0 and about 20 wt. %, more preferably between about 0.5 wt. % and about 15 wt. %, and most preferably between about 2 wt. % and about 9 wt. %.

Enzymes

Enzymes can be included in the composition to aid in soil removal of robust soils such as starch, protein, and the like. Exemplary types of enzymes include proteases, alpha-amylases, and mixtures thereof. Exemplary proteases that can be used include those derived from *Bacillus licheniformix, Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. The concentrate need not include an enzyme. When the concentrate includes an enzyme, it can be included in an amount that provides the desired enzymatic activity when the warewashing composition is provided as a use composition. Exemplary ranges of the enzyme in the concentrate include between about 0 and about 15 wt. %, more preferably between about 0.5 wt. % and about 10 wt. %, and most preferably between about 1 wt. % and about 5 wt. %.

In addition to providing alkalinity and having anti-redeposition properties silicates can also provide further metal protection. Exemplary silicates include sodium silicate and potassium silicate. The detergent composition can be provided without silicates, but when silicates are included, they can be included in amounts that provide for desired metal protection. The concentrate can include silicates in a range between about 10 wt. % and about 80 wt. %, more preferably between about 30 wt. % and about 70 wt. %, and most preferably between about 40 wt. % and 60 wt. %.

Dyes, Odorants, and the Like

Various dyes, odorants including perfumes, and other aesthetic enhancing agents can be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Formulations

The detergent compositions according to the invention may be formulated into solids, liquids, powders, pastes, gels, etc.

Solid detergent compositions provide certain commercial advantages for use according to the invention. For example, use of concentrated solid detergent compositions decrease shipment costs as a result of the compact solid form, in comparison to bulkier liquid products. In certain embodiments of the invention, solid products may be provided in the form of a multiple-use solid, such as, a block or a plurality of pellets, and can be repeatedly used to generate aqueous use solutions of the detergent composition for multiple cycles or a predetermined number of dispensing cycles. In certain embodiments, the solid detergent compositions may have a mass greater than about 5 grams, such as for example from about 5 grams to 10 kilograms. In certain embodiments, a multiple-use form of the solid detergent composition has a mass of about 1 kilogram to about 10 kilogram or greater.

When the components that are processed to form the detergent are processed into a block, it is expected that the components can be processed by extrusion, casting, or pressed solid techniques. In general, when the components are processed by extrusion techniques, it is believed that the composition can include a relatively smaller amount of water as an aid for processing compared with the casting techniques. In general, when preparing the solid by extrusion, it is expected that the composition can contain between about 2 wt. % and about 10 wt. % water. When preparing the solid by casting, it is expected that the amount of water can be provided in an amount between about 20 wt. % and about 50 wt. %.

The detergents of the invention may exist in a use solution or concentrated solution that is in any form including liquid, free flowing granular form, powder, gel, paste, solids, slurry, and foam.

In some embodiments, in the formation of a solid composition, a mixing system may be used to provide for continuous mixing of the ingredients at high enough shear to form a substantially homogeneous solid or semi-solid mixture in which the ingredients are distributed throughout its mass. In some embodiments, the mixing system includes means for mixing the ingredients to provide shear effective for maintaining the mixture at a flowable consistency, with a viscosity during processing in the range of about 1,000-1,000,000 cP, or in the range of about 50,000-200,000 cP. In some example embodiments, the mixing system can be a continuous flow mixer or in some embodiments, an extruder, such as a single or twin screw extruder apparatus. A suitable amount of heat may be applied from an external source to facilitate processing of the mixture.

The mixture is typically processed at a temperature to maintain the physical and chemical stability of the ingredients. In some embodiments, the mixture is processed at temperatures in the range of about 100 to 140° F. In certain other embodiments, the mixture is processed at temperatures in the range of 110-125° F. Although limited external heat may be applied to the mixture, the temperature achieved by the mixture may become elevated during processing due to friction, variances in ambient conditions, and/or by an exothermic reaction between ingredients. Optionally, the temperature of the mixture may be increased, for example, at the inlets or outlets of the mixing system.

An ingredient may be in the form of a liquid or a solid such as a dry particulate, and may be added to the mixture separately or as part of a premix with another ingredient, as for example, the preservative, dispersant, sequestrant, hydrotrope, chelants, an aqueous medium, hardening agent and the like. One or more premixes may be added to the mixture.

The ingredients are mixed to form a substantially homogeneous consistency wherein the ingredients are distributed substantially evenly throughout the mass. The mixture can be discharged from the mixing system through a die or other shaping means. The profiled extrudate then can be divided into useful sizes with a controlled mass. Optionally, heating and cooling devices may be mounted adjacent to mixing apparatus to apply or remove heat in order to obtain a desired temperature profile in the mixer. For example, an external source of heat may be applied to one or more barrel sections of the mixer, such as the ingredient inlet section, the final outlet section, and the like, to increase fluidity of the mixture during processing. In some embodiments, the temperature of the mixture during processing, including at the discharge port, is maintained in the range of about 100 to 140° F.

The composition hardens due to the chemical or physical reaction of the requisite ingredients forming the solid. The solidification process may last from a few minutes to about six hours, or more, depending, for example, on the size of the cast or extruded composition, the ingredients of the composition, the temperature of the composition, and other like factors. In some embodiments, the cast or extruded composition "sets up" or begins to hardens to a solid form within about 1 minute to about 3 hours, or in the range of about 1 minute to about 2 hours, or in some embodiments, within about 1 minute to about 20 minutes.

In some embodiments, the extruded solid can be packaged, for example in a container or in film. The temperature of the mixture when discharged from the mixing system can be sufficiently low to enable the mixture to be cast or extruded directly into a packaging system without first cooling the mixture. The time between extrusion discharge and packaging may be adjusted to allow the hardening of the composition for better handling during further processing and packaging. In some embodiments, the mixture at the point of discharge is in the range of about 100 to 140° F. In certain other embodiments, the mixture is processed at temperatures in the range of 110-125° F. The composition is then allowed to harden to a solid form that may range from a low density, sponge-like, malleable, caulky consistency to a high density, fused solid, concrete-like solid.

Methods of Use

Methods of use employing the detergent compositions according to the invention are particularly suitable for institutional ware washing. Exemplary disclosure of ware-washing applications is set forth in U.S. patent application Ser. Nos. 13/474,771, 13/474,780 and 13/112,412, including all references cited therein, which are herein incorporated by reference in its entirety. The method may be carried out in any consumer or institutional dish machine, including for example those described in U.S. Pat. No. 8,092,613, which is incorporated herein by reference in its entirety, including all figures and drawings. Some non-limiting examples of dish machines include door machines or hood machines, conveyor machines, undercounter machines, glasswashers, flight machines, pot and pan machines, utensil washers, and consumer dish machines. The dish machines may be either single tank or multi-tank machines.

A door dish machine, also called a hood dish machine, refers to a commercial dish machine wherein the soiled dishes are placed on a rack and the rack is then moved into the dish machine. Door dish machines clean one or two racks at a time. In such machines, the rack is stationary and the wash and rinse arms move. A door machine includes two sets arms, a set of wash arms and a rinse arm, or a set of rinse arms.

Door machines may be a high temperature or low temperature machine. In a high temperature machine the dishes are sanitized by hot water. In a low temperature machine the dishes are sanitized by the chemical sanitizer. The door machine may either be a recirculation machine or a dump and fill machine. In a recirculation machine, the detergent solution is reused, or "recirculated" between wash cycles. The concentration of the detergent solution is adjusted between wash cycles so that an adequate concentration is maintained. In a dump and fill machine, the wash solution is not reused between wash cycles. New detergent solution is added before the next wash cycle. Some non-limiting examples of door machines include the Ecolab Omega HT, the Hobart AM-14, the Ecolab ES-2000, the Hobart LT-1, the CMA EVA-200, American Dish Service L-3DW and HT-25, the Autochlor A5, the Champion D-HB, and the Jackson Tempstar.

In addition, the methods of use of the detergent compositions are also suitable for CIP and/or COP processes to replace the use of bulk detergents leaving hard water residues on treated surfaces. The methods of use may be desirable in additional applications where industrial standards are focused on the quality of the treated surface, such that the prevention of hard water scale accumulation provided by the detergent compositions of the invention are desirable. Such applications may include, but are not limited to, vehicle care, industrial, hospital and textile care.

Additional examples of applications of use for the detergent compositions include, for example, alkaline detergents effective as grill and oven cleaners, ware wash detergents, laundry detergents, laundry presoaks, drain cleaners, hard surface cleaners, surgical instrument cleaners, transportation vehicle cleaning, vehicle cleaners, dish wash presoaks, dish wash detergents, beverage machine cleaners, concrete cleaners, building exterior cleaners, metal cleaners, floor finish strippers, degreasers and burned-on soil removers. In a variety of these applications, cleaning compositions having a very high alkalinity are most desirable and efficacious, however the damage caused by corrosion of metal is undesirable.

The various methods of use according to the invention employ the use of the detergent composition, which may be formed prior to or at the point of use by combining the alkalinity source, amino carboxylate and other desired components (e.g. optional polymers and/or surfactants) in the weight percentages disclosed herein.

In certain embodiments, the detergent composition may be mixed with a water source prior to or at the point of use. In other embodiments, the detergent compositions do not require the formation of a use solution and/or further dilution and may be used without further dilution.

In aspects of the invention employing solid detergent compositions, a water source contacts the detergent composition to convert solid detergent compositions, particularly powders, into use solutions. Additional dispensing systems may also be utilized which are more suited for converting alternative solid detergents compositions into use solutions. The methods of the present invention include use of a variety of solid detergent compositions, including, for example, extruded blocks or "capsule" types of package.

In an aspect, a dispenser may be employed to spray water (e.g. in a spray pattern from a nozzle) to form a detergent use solution. For example, water may be sprayed toward an apparatus or other holding reservoir with the detergent composition, wherein the water reacts with the solid detergent composition to form the use solution. In certain embodiments of the methods of the invention, a use solution may be configured to drip downwardly due to gravity until the dissolved solution of the detergent composition is dispensed for use according to the invention. In an aspect, the use solution may be dispensed into a wash solution of a ware wash machine.

Sample Formulas of the Invention

All are in percent by weight of the composition. Additional components as described herein can amount to as much as 0.001 to about 15 wt. % of the composition.

| Component | preferred range | more preferred | most preferred |
|---|---|---|---|
| Alkalinity | 0.05-99 | 0.1-95 | 0.5-90 |
| Amino carboxylate | 0.01-7 | 0.04-5 | 0.1-3.5 |
| Silicate | 5-40 | 10-35 | 15-30 |

-continued

| Component | preferred range | more preferred | most preferred |
|---|---|---|---|
| Surfactant | 0.05-15 | 0.5-10 | 1-7.5 |
| corrosion inhibitor | 0.01-25 | 0.05-20 | 0.1-15 |
| chelant | 0.1-20 | 0.5-15 | 1-10 |
| water | 2-20 | 3-15 | 4-10 |

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Example 1

Pluronic LF221 is an Ethylene/Propylene Oxide Block Copolymer surfactant commercially available from BASF Pluronic N-3 is an Ethylene/Propylene Oxide Block Copolymer surfactant commercially available from BASF Acumer 5000 is a Magnesium Silicate polymer commercially available from Dow Versaflex Si is an acrylic copolymer commercially available from available from Akzo Nobel.

Acusol 425, 929 and 445 N are acrylic acid co-polymers available from Dow.

Belclene 200 is polymalaeic acid polymer commercially available from BioLab Water Additives.

Compositions were made according to the invention including Apex Metal, a commercially available alkaline ware wash detergent from Ecolab which does not have amino carboxylate, one with amino carboxylate according to the invention, one with another metal protection component, Versaflx Si, and one with Acumer 5000. In each instance, a portion of the metal protecting silicate was substituted with a different metal protection component. Each was tested in a multi-cycle aluminum corrosion inhibition evaluation per the method below.

Multi-Cycle Aluminum Corrosion Inhibition Evaluation for Institutional Warewash Detergents or Rinse Aids Purpose:

To provide a generic method for evaluating the aluminum pan corrosion in an institutional dish machine. The procedure is used to evaluate test formulations, Ecolab products, and competitive products.

Apparatus and Materials:

1. Institutional dishwasher hooked up to appropriate water supply.
2. Raburn pan rack.
3. Aluminum sheet pan, 13"×9" obtained by cutting 13"×18" pan in half
4. Balance
5. Sufficient detergent to complete test.

Preparation:

1. Lightly clean aluminum pan with warm soapy water and a non-abrasive sponge to ensure any foreign materials or residues from cutting and storage have been removed.
2. Fill the dishmachine with the type of water wanted: city, soft, or well, and turn on heaters.
3. Adjust the final rinse temperature to 180° F. for the high temperature machines.
4. Prime the warewash machine with desired concentration of detergent.
5. Place the pan in the second slot from front with the rim facing down and cut edge facing up.
6. Start the machine. Push pan rack into machine and start cycle.
7. At the beginning of each cycle, the appropriate amount of detergent are added to the wash tank to make up for the rinse dilution.
8. Repeat steps 6 and 7 until the desired number of cycles are complete.
9. Run a standard Ecolab detergent or rinse aid for comparison of test formulas.

Evaluation Results:

Pans are rated visually and photographed against a black background. The rating scale used is as follows and is the same for the front and back of each pan:

| Rating | Film |
|---|---|
| 1 | No corrosion or discoloration |
| 2 | Approximately 25% of the pan is discolored and/or corroded |
| 3 | Approximately 50% of the pan is discolored and/or corroded |
| 4 | Approximately 75% of the pan is discolored and/or corroded |
| 5 | All or nearly all of the pan is heavily discolored and/or corroded |

Results are shown in Table 1 below.

TABLE 1

Multi-Cycle Aluminum Corrosion Inhibition Evaluation Results

| Experiment | Description | Results at the low end of the recommended use range | Results at the low end of the recommended use range |
|---|---|---|---|
| 1 | Control - current metal protecting formula using only silicate. | 3.5 | 3 |
| 2 | Metal protecting formula using amino carboxylate in addition to silicate. | 1.5 | 1.5 |
| 3 | Metal protecting formula using Acumer 5000 | 4.0 | 3.0 |
| 4 | Metal protecting formula using Versaflex SI | 4.5 | 3.5 |

TABLE 1-continued

| Multi-Cycle Aluminum Corrosion Inhibition Evaluation Results | | | |
|---|---|---|---|
| Experiment | Description | Results at the low end of the recommended use range | Results at the low end of the recommended use range |
| 5 | Metal protecting formula using amino carboxylate instead of silicate. | N/A - test not completed due to poor results at high end of use range. | 5.0 |

Example 2

The dispensing system test is designed to replicate the clogging of dispensers. A dispensing assembly is a stand that holds multiple dispensers side by side to dispense multiple products at the same time. The detergent blocks in the dispenser are sprayed from the bottom and the fluid runs out of the dispenser through a tube to the drain. The initial test parameters were set to spray 17 grain water, temperature range from 85-95 degree Fahrenheit, with a spray time of 5 minutes on and 20 minutes off. The dispensing time was changed after 14 days for the remainder of the test, alternating spray times of 2 minutes on and 40 minutes off. The test was run for 90 days dispensing total of 52 detergent blocks. The results are shown in Table 2 below.

TABLE 2

| Dispensing System Test Results | | | | |
|---|---|---|---|---|
| Description | Results After 12 Blocks | Results After 17 Blocks | Results After 20 Blocks | Results After 52 Blocks |
| Control - current metal protecting formula using only silicate. | Some signs of white film inside dispenser. | Considerable amount of white material collecting on the bottom of dispenser, elbow, nozzle & basket | Dispenser fully clogged - End dispensing on control | |
| Metal protecting formula using amino carboxylate in addition to silicate. | No deposit or signs of clogging | No deposit or signs of clogging | No deposit or signs of clogging | Clog free-dispense same as FT account for 3 months 52 blocks. |

The inventions being thus described, it will be obvious that the same may be varied in many ways. Such variations are not to be regarded as a departure from the spirit and scope of the inventions and all such modifications are intended to be included within the scope of the following claims.

What is claimed is:

1. A solid alkaline detergent composition comprising:

from about 0.5 wt. % to about 90 wt. % of an alkalinity source;

from about 1 wt. % to about 7.5 wt. % of one or more nonionic surfactants;

from about 15 wt. % to about 30 wt. % of a silicate and from about 0.01 wt % to about 3.5 wt % of an amino carboxylate comprising methyl-glycine-diacetic acid (MGDA), glutamic-N,N-diacetic acid (GLDA), a salt thereof, or a derivative thereof;

from about 0.1 wt. % to about 15 wt. % of at least one acrylic acid polymer having a molecular weight between 1,000 g/mol to 1,000,000 g/mol;

from about 1 wt. % to about 10 wt. % of a phosphonic acid, and from about 4 wt. % to about 10 wt. % of water.

2. The composition of claim 1, wherein the acrylic acid polymer(s) have a molecular weight between 1,000 g/mol and 10,000 g/mol.

3. The composition of claim 1, wherein the phosphonic acid comprises amino tri(methylene phosphonic acid), 1-hydroxy ethylidene 1-1-diphosphonic acid, ethylene diamine tetra (methylene phosphonic acid), hexamethylene diamine tetra (methylene phosphonic acid), diethylene triamine penta (methylene phosphonic acid), or mixtures thereof.

4. The detergent of claim 1, wherein said alkalinity source includes an alkali metal hydroxide, or a carbonate.

5. The composition of claim 1, wherein the phosphonic acid comprises an ethylenediaminetetrakis(methylenephosphonate).

6. The composition of claim 1, wherein the nonionic surfactant contains a polyethylene oxide, polypropylene oxide, polyethylene-oxide-polypropylene oxide block polymer moiety, or combination thereof within its structure.

7. The composition of claim 1, wherein the solid detergent is a solid selected from the group comprising a cast solid, a pressed solid, or an extruded solid.

8. A method of cleaning ware while preventing magnesium carbonate accumulation from hard water comprising:

applying the detergent composition of claim 1 to a ware surface; and thereafter rinsing said ware.

* * * * *